US008783432B2

(12) United States Patent
Wang

(10) Patent No.: US 8,783,432 B2
(45) Date of Patent: Jul. 22, 2014

(54) ULTRA LIGHTWEIGHT SUITCASE

(75) Inventor: Xiangjun Wang, Shanghai (CN)

(73) Assignee: Shanghai Newest Luggage Co., Ltd. (CN)

( * ) Notice: Subject to any disclaimer, the term of this patent is extended or adjusted under 35 U.S.C. 154(b) by 465 days.

(21) Appl. No.: 13/123,247

(22) PCT Filed: Oct. 23, 2009

(86) PCT No.: PCT/CN2009/001184

§ 371 (c)(1), (2), (4) Date: Apr. 8, 2011

(87) PCT Pub. No.: WO2011/017827

PCT Pub. Date: Feb. 17, 2011

(65) Prior Publication Data

US 2011/0192689 A1 Aug. 11, 2011

(30) Foreign Application Priority Data

Aug. 14, 2009 (CN) ..... 2009 2 0207891

(51) Int. Cl.
*A45C 13/04* (2006.01)
*A45C 13/26* (2006.01)

(52) U.S. Cl.
USPC ..... 190/124; 190/18 R; 190/18 A; 190/115; 190/37

(58) Field of Classification Search
USPC ..... 190/18 R, 18 A, 115, 37, 124
See application file for complete search history.

(56) References Cited

U.S. PATENT DOCUMENTS

| | | | | | |
|---|---|---|---|---|---|
| 4,813,520 | A * | 3/1989 | Lin | 190/107 |
| 5,115,895 | A * | 5/1992 | Myers | 190/18 A |
| 5,782,325 | A * | 7/1998 | O'Shea et al. | 190/18 A |
| 5,833,039 | A * | 11/1998 | Kotkins, Jr. | 190/115 |
| 6,131,713 | A * | 10/2000 | Sher | 190/122 |
| 6,176,357 | B1 * | 1/2001 | Kuo | 190/18 A |
| 6,283,261 | B1 * | 9/2001 | Sher | 190/122 |

FOREIGN PATENT DOCUMENTS

| | | | | |
|---|---|---|---|---|
| DE | 19525571 A1 * | 1/1996 | | A45C 5/14 |
| GB | 2453787 A * | 4/2009 | | A45C 5/03 |
| WO | WO 2008009905 A1 * | 1/2008 | | A45C 5/14 |

* cited by examiner

*Primary Examiner* — Tri Mai
(74) *Attorney, Agent, or Firm* — Wilmer Cutler Pickering Hale and Dorr LLP

(57) ABSTRACT

An ultralight suitcase comprises a case framework, case material, pull rods, wheels and supporting legs. The case framework comprises upper connectors, lower connectors, upper corner connectors and lower corner connectors; the bottom parts of the lower corner connectors are connected with the supporting legs; the upper connectors and the lower connectors are connected through supporting connectors; the upper corner connectors and the lower corner connectors are connected through supporting connectors; the upper connectors are connected through supporting connectors; the lower connectors are connected through supporting connectors; the upper corner connectors are connected through supporting connectors; the lower corner connectors are connected through supporting connectors; the whole framework of the case is firmer through the buckling connection between the upper corner connectors and the upper connectors and between the lower corner connectors and the lower connectors, and the total weight of the suitcase remains unchanged.

5 Claims, 10 Drawing Sheets

ULTRA LIGHTWEIGHT SUITCASE

CROSS REFERENCE TO RELATED APPLICATIONS

This application is a national stage application under 35 U.S.C. §371 of International Patent Application No. PCT/CN2009/001184, designating the United States and filed on Oct. 23, 2009, which claims the benefit of priority under 35 U.S.C. §119(a) to Chinese Patent Application No. 200920207891.2, filed Aug. 14, 2009, all of which are hereby incorporated by reference in their entirety.

TECHNICAL FIELD

The invention relates to a suitcase or trunk for travelling, in particular an ultralight suitcase with a firm framework.

TECHNICAL BACKGROUND

Generally, there is a weight standard for luggage to be carried on a plane or a train to limit the total weight of the luggage. Therefore, more and more consumers will select a suitcase with light total weight and large supporting power, so as to put more articles in the luggage and to meet the weight standard of the luggage.

As shown in FIG. 1, the existing lightweight suitcase on the market mainly comprises a case framework 1 and case material coated outside the case framework 1. In order to reduce the weight of the suitcase, the case framework 1 comprises connecting rods 2, three-way connectors 3, four-way connectors 4 and pull rods 5, wherein the connecting rods 2, the three-way connectors 3, the four-way connectors 4 and the pull rods 5 are spliced together to form the case framework 1; then wheels 6 and supporting legs 7 at the bottom part of the suitcase are respectively connected with the bottom part of the case framework 1; the pull rods 5 are fixed in the case framework 1 through cover plates 8; and the case material coated outside the case framework 1 tightly combines every part of the case framework 1 into a whole body.

Although the case framework 1 of the existing suitcase is light, its fastness needs to be improved, because the connecting rods 2, the three-way connectors 3, the four-way connectors 4 and the pull rods 5 are connected to one another. For example, the three-way connectors 3 and the four-way connectors 4 for connecting the connecting rods 2 are not firm enough and can easily break.

Meanwhile, as the case framework 1 comprises the connecting rods 2, the three-way connectors 3, the four-way connectors 4 and the pull rods 5, which are connected to one another. When the case material is coated, lining boards 9 are required to be arranged on the two sides of the upper part of the case framework 1 to ensure that the case material be coated more tightly on the case framework 1. In addition, the pull rods 5 of the suitcase adopt traditional extension pull rods without locking pieces. The positions of the pull rods 5 cannot be adjusted freely, and as a result, the use of the suitcase is inconvenient, and the suitcase cannot be pushed to move forward through the pull rods 5.

FIG. 2 shows the pull rod structure of another suitcase, wherein pull rods 2' are arranged in the center position of the rear part of a case framework 1'; the middle parts of the pull rods 2' are sleeved in an upper cover plate 21'; the pull rods 2' are fixed on the case framework 1' by connecting the pull rods 2' with the upper cover plate inner lining 22' arranged in the center position of the rear part of a case framework 1'; the bottom parts of the pull rods 2' are fixed at the bottom part of the case framework 1' through a lower base; the extension of the pull rods 2' is realized by stretching pull rod inner tubes 24' in pull rod outer tubes 25'. However, the pull rods 2' are still not provided with locking pieces, the positions of the pull rods 2' can not be adjusted freely. Therefore, the use of the suitcase is inconvenient, and the suitcase cannot be pushed to move forward through the pull rods 2'.

SUMMARY OF THE INVENTION

In order to solve these problems, the invention provides a combined type ultralight suitcase, which structure is firmer while the total weight of the suitcase is not changed.

In order to effect the purpose, the invention adopts the technical scheme as follows:

A combined type ultralight suitcase comprises a case framework, case materials covered on the case framework, pull rods installed on the case framework and wheels and supporting legs installed at the bottom part of the case framework, characterized in that the case framework comprises upper connectors connected with the two ends of the pull rods, lower connectors connected with the wheels at the lower part of the case framework, upper corner connectors connected with the upper connectors and lower corner connectors connected with the lower connectors; the bottom parts of the lower corner connectors are connected with the supporting legs; the upper connectors and the lower connectors are connected through supporting connectors; the upper corner connectors and the lower corner connectors are connected through supporting connectors; the upper connectors are connected through supporting connectors; the lower connectors are connected through supporting connectors; the upper corner connectors are connected through supporting connectors; and the lower corner connectors are connected through supporting connectors.

In one embodiment of the invention, screw stubs are arranged on the upper connectors on the inner sides of the connected sides between the upper connectors and the upper corner connectors; screw holes are arranged on the upper corner connectors corresponding to the positions of the screw stubs on the upper connectors; and the upper connectors and the upper corner connectors are connected by tightly screwing the screw stubs into the screw holes.

In one embodiment of the invention, the upper connectors are buckled and connected with the upper corner connectors.

In one embodiment of the invention, screw stubs are arranged on the lower connectors on the inner sides of the connected sides between the lower connectors and the lower corner connectors; screw holes are arranged on the lower corner connectors corresponding to the positions of the screw stubs on the lower connectors; and the lower connectors and the lower corner connectors are connected by tightly screwing the screw stubs into the screw holes.

In one embodiment of the invention, the lower connectors are buckled and connected with the lower corner connectors.

In one embodiment of the invention, splicing connectors are arranged in the connected positions between the upper connectors, the lower connectors, the upper corner connectors, the lower corner connectors and the supporting connectors; a mounting through-hole for splicing the corresponding supporting connector arranged in the center of the splicing connector; and fastening holes are arranged on the splicing connectors and the supporting connectors are fixed through fastening screws.

In one embodiment of the invention, the supporting connector adopts a strip supporting connector; positioning holes are respectively arranged at two ends of each supporting connector; mounting stubs are arranged on the upper connectors, the lower connectors, the upper corner connectors and the lower corner connectors in the positions corresponding to the positioning holes; the supporting connectors are installed on the mounting stubs on the upper connectors, the lower connectors, and the upper corner connectors and the lower corner connectors from the positioning holes through mounting pieces.

In one embodiment of the invention, the outer tubes of the pull rods are connected between the upper connectors and the lower connectors; the inner tubes of the pull rods are arranged inside the outer tubes; the pull rods are fixed in the case framework through an upper cover plate; and the upper cover plates are fixedly connected with the upper connectors.

Further, locking pieces for locking the positions of the pull rods are arranged on the upper cover plates; the locking pieces comprise a locking switch and a lock body; the locking switch is connected with the lock body; a limiting hole is arranged on the upper cover plate; and a limiting block which can extend into the limiting hole to limit the pull rods is arranged on the lock body.

The invention has advantages in that the whole framework of the combined type ultralight suitcase is firmer through the mutual connections between the upper corner connectors and the upper connectors as well as between the lower corner connectors and the lower connectors. When the case material is coated on the case framework, lining boards are not required. In addition, the suitcase is economic, practical and artistic without changing the total weight of the suitcase, and as a result, the purpose of the invention is achieved.

DESCRIPTION OF FIGURES

The invention is illustrated through figures and specific embodiments in detail as follows.

EMBODIMENTS

The present invention is further illustrated below along with figures in order for people to easily understand the technical means, characteristics, purposes and efficiencies of the present invention.

Examples

Figure 1:
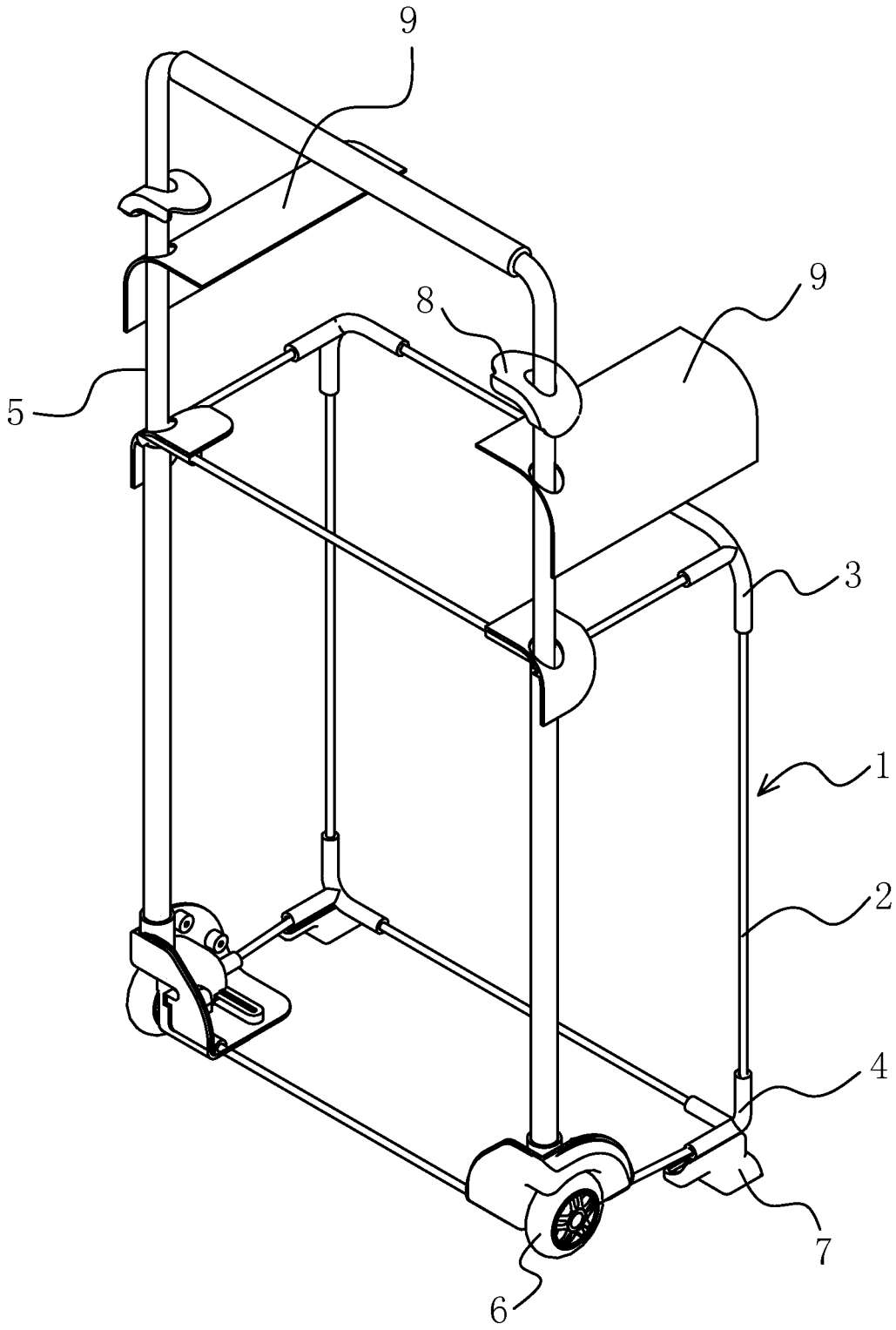
Figure 1 PRIOR ART
FIG. 1 illustrates the structure diagram of an existing lightweight suitcase.
Figure 2:
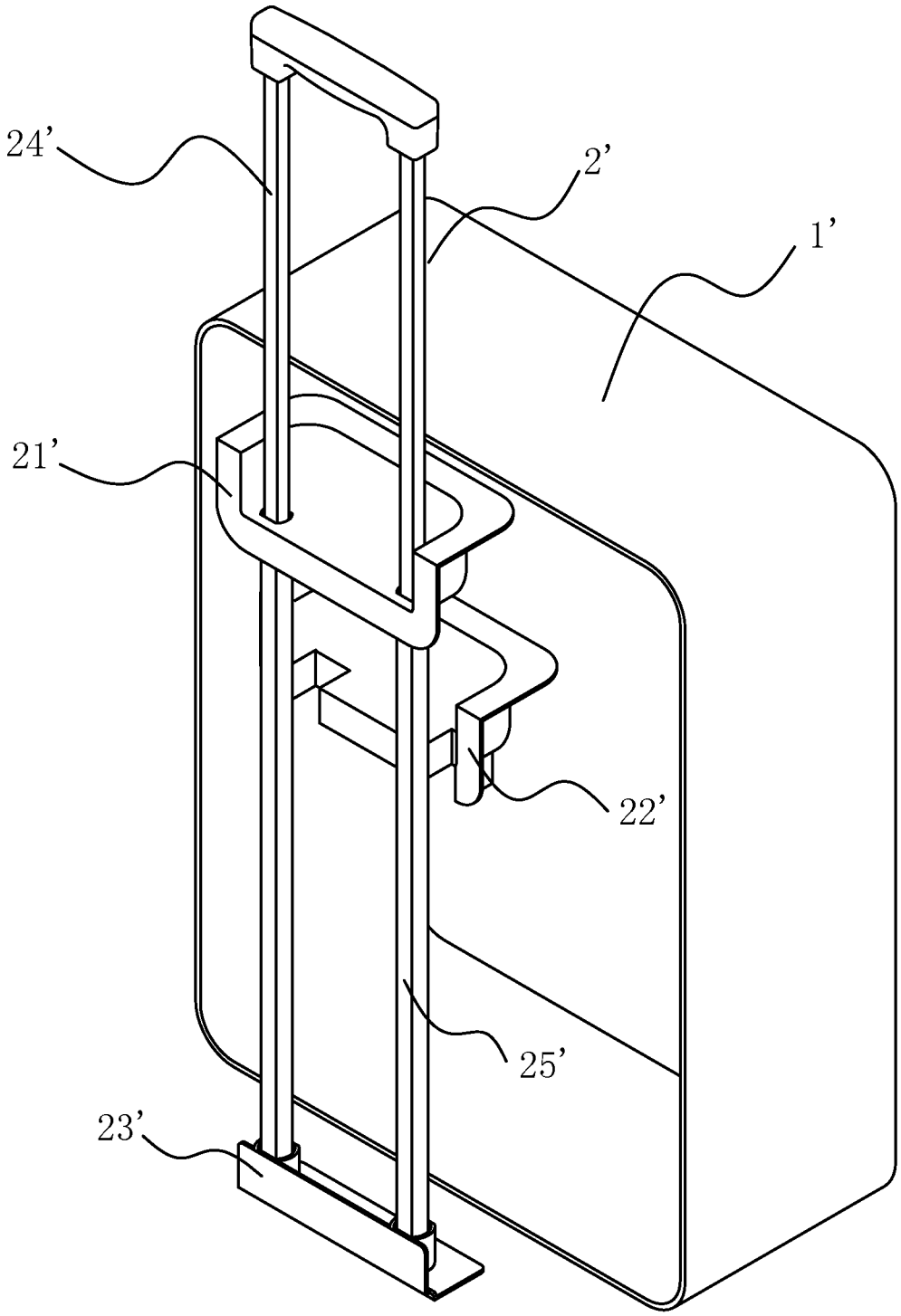
Figure 2 PRIOR ART
FIG. 2 illustrates the structure diagram of another existing suitcase.
Figure 3:
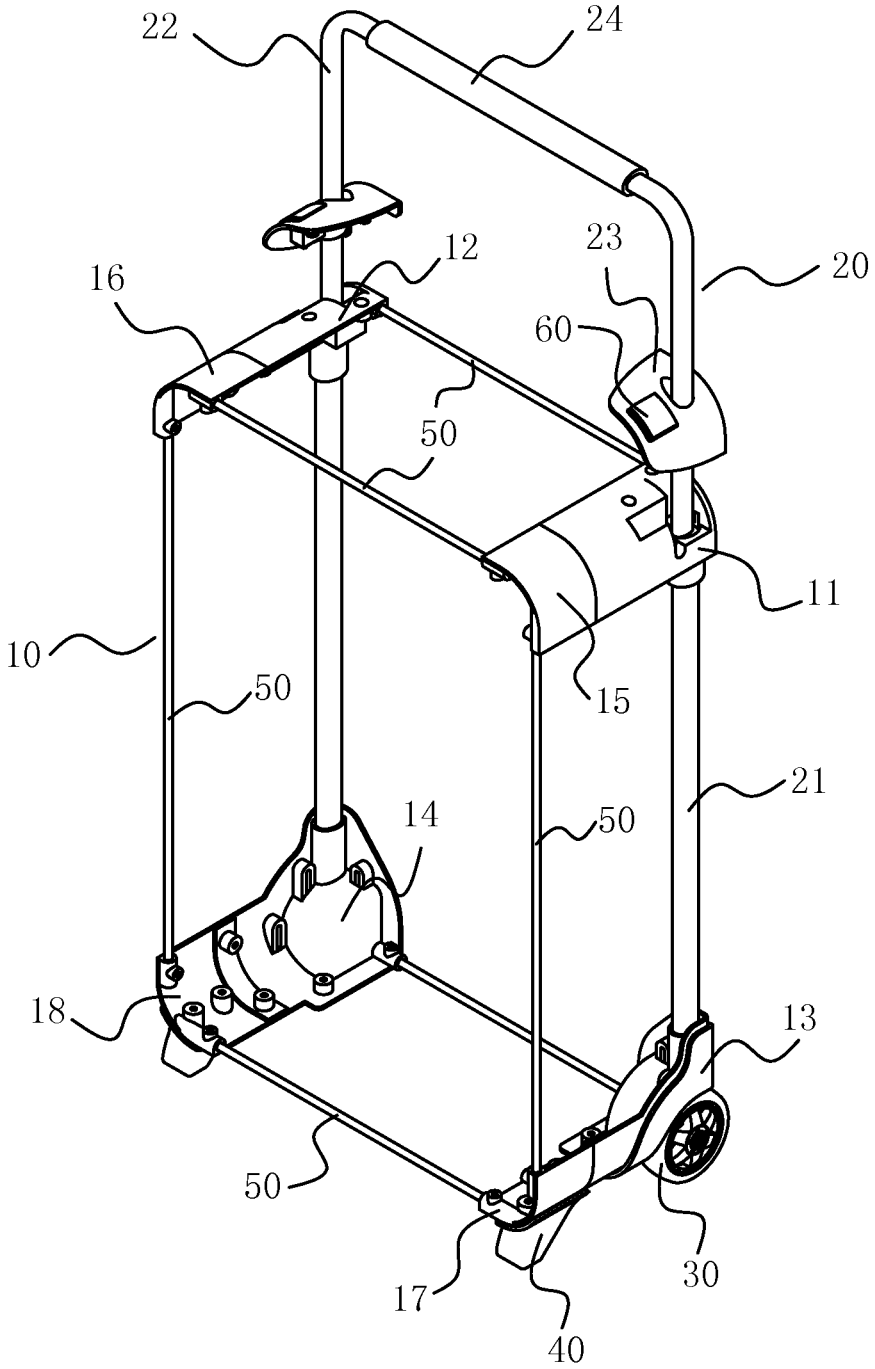
FIG. 3 illustrates the structure diagram of a combined type ultralight suitcase of the present invention.
Figure 4:
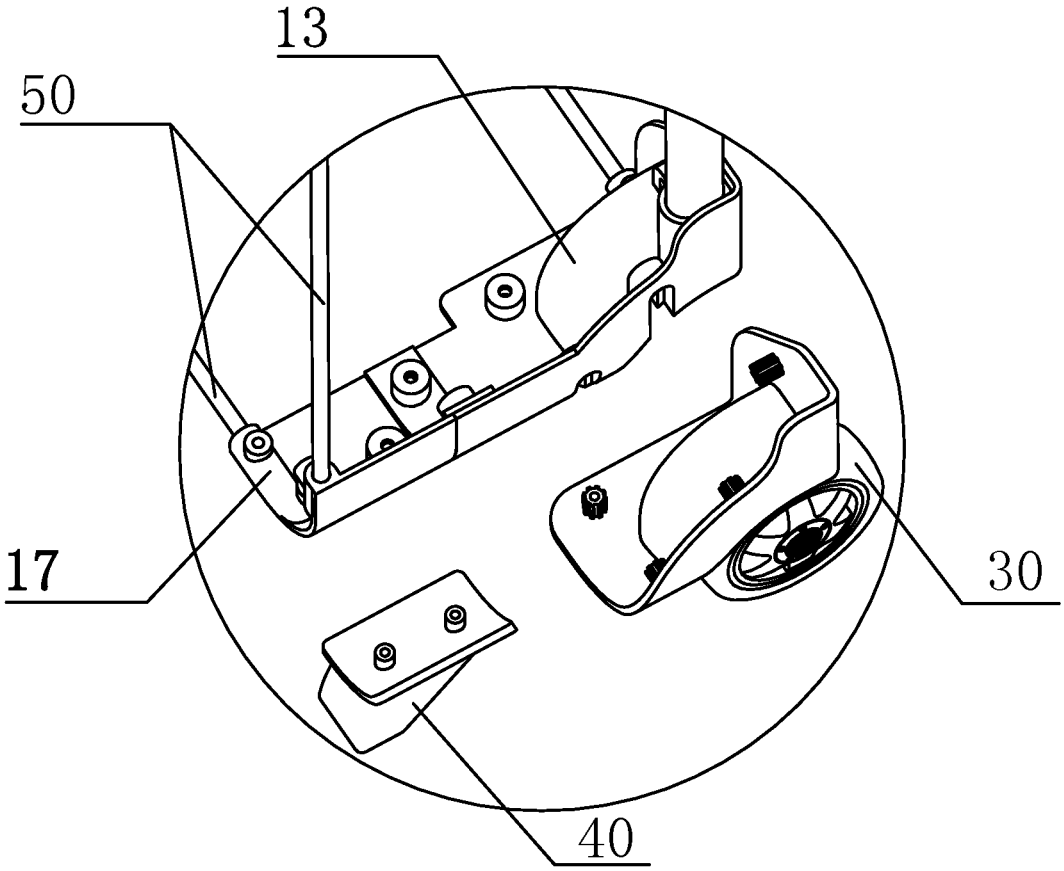
FIG. 4 illustrates the structure diagram of the connection of the supporting legs and the wheels of the ultralight suitcase of the present invention.

As shown in FIG. 3, the combined type ultralight suitcase comprises a case framework 10, case material (not shown in the figure) coated on the case framework 10, pull rods 20 installed on the case framework 10, and wheels 30 and supporting legs 40 installed at the bottom part of the case framework 10; the case framework 10 comprises an upper connector 11 and an upper connector 12 which are connected with two ends of the pull rod, a lower connector 13 and a lower connector 14 which are connected with wheels 30 of the lower parts of the case framework 10, an upper corner connector 15 connected with the upper connector 11, an upper corner connector 16 connected with the upper connector 12, a lower corner connector 17 connected with the lower connector 13, and a lower corner connector 18 connected with the lower connector 14, wherein the lower parts of the lower corner connector 17 and the lower corner connector 18 are connected with supporting legs 40 (as shown in FIG. 4); the upper connector 11 and the upper connector 12 with the lower connector 13 and the lower connector 14, the upper corner connector 15 and the upper corner connector 16 with the lower corner connector 17 and the lower corner connector 18, the upper connector 11 with the upper connector 12, the lower connector 13 with the lower connector 14, the upper corner connector 15 with the upper corner connector 16, and the lower corner connector 17 with the lower corner connector 18 are connected through supporting connectors 50.

Figure 5:
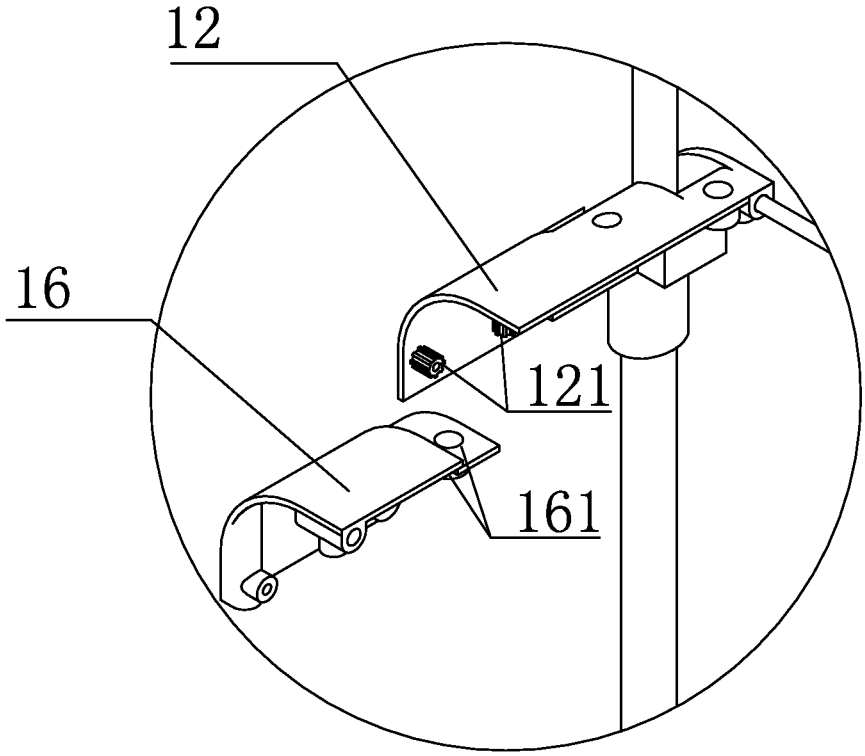
FIG. 5 illustrates the structure diagram of the connection of upper connectors and upper corner connectors of the ultralight suitcase of the present invention.

As shown in FIG. 5, screw stubs 121 are arranged on the upper connector 12 on the inner side of the connected side between the upper connector 12 and the upper corner connector 16; screw holes 161 are arranged on the upper corner connector 16 corresponding to the position of the screw stubs 121 on the upper connector 12; the upper connector 12 and the upper corner connector 16 are secured by fastening the screw stubs 121 into the screw holes 161. Similarly, the upper connector 12 can be connected with the upper corner connector 16 through a buckle.

The connection structure between the upper connector 11 and the upper corner connector 15 is identical with that between the upper connector 12 and the upper corner connector 16, which description is not repeated here.

Figure 6:
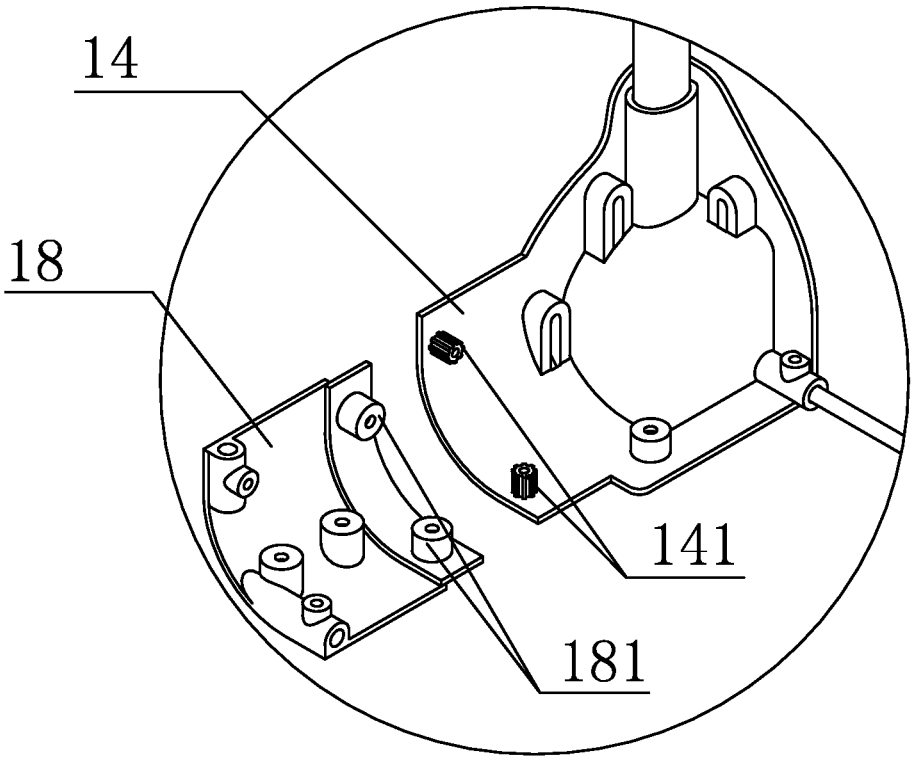
FIG. 6 illustrates the structure diagram of the connection of the lower connectors and the lower corner connectors of the ultralight suitcase of the present invention.

As shown in FIG. 6, screw stubs 141 are arranged on the inner side of the lower connector 14 connected to the lower corner connector 18; screw holes 181 are arranged on the lower corner connector 18 corresponding to the position of the screw stub 141 on the lower connector 14; the lower connector 14 and the lower corner connector 18 are secured by fastening the screw stubs 141 into the screw holes 181. Similarly, the lower connector 14 can be connected with the lower corner connector 18 through a buckle.

The connection structure between the lower connector 13 and the lower corner connector 17 is identical with that between the lower connector 14 and the lower corner connector 18, which description is not repeated here.

Figure 7:
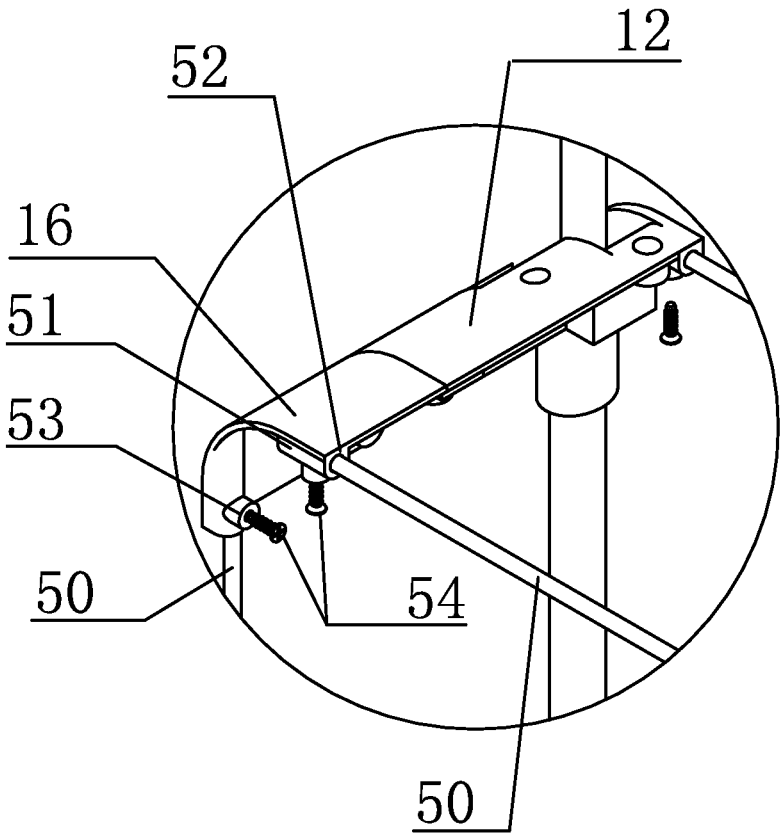
FIG. 7 illustrates the structure diagram of the connection of one type of supporting connectors of the ultralight suitcase of the present invention.

As shown in FIG. 7, a splicing connector 51 is arranged on the upper corner connector 16 at the connected position between the upper corner connector 16 and a supporting connector 50, a mounting through hole 52 is arranged in the center of the splicing connector 51, the supporting connector 50 is spliced in the mounting through hole 52, a fastening hole 53 is arranged on the splicing connector 51, and the supporting connector 50 is fixed through a fastening screw 54 penetrating the fastening hole 5. Meanwhile, the length of the whole case framework 10 can be adjusted by adjusting the distance of the supporting connector 50 in the mounting through hole 52, to reduce the length error caused when the case material is coated on the case framework 10; and as a result, the quality and production yield of the suitcases are improved.

Similarly, the connection structures of the upper connector 11, the upper connector 12, the lower connector 13, the lower connector 14, the upper corner connector 15, the lower corner connector 17 and the lower corner connector 18 connecting with the supporting connector 50 are identical with that of the upper corner connector 16 connecting with the supporting connector 50, which description is not repeated here.

Figure 8:
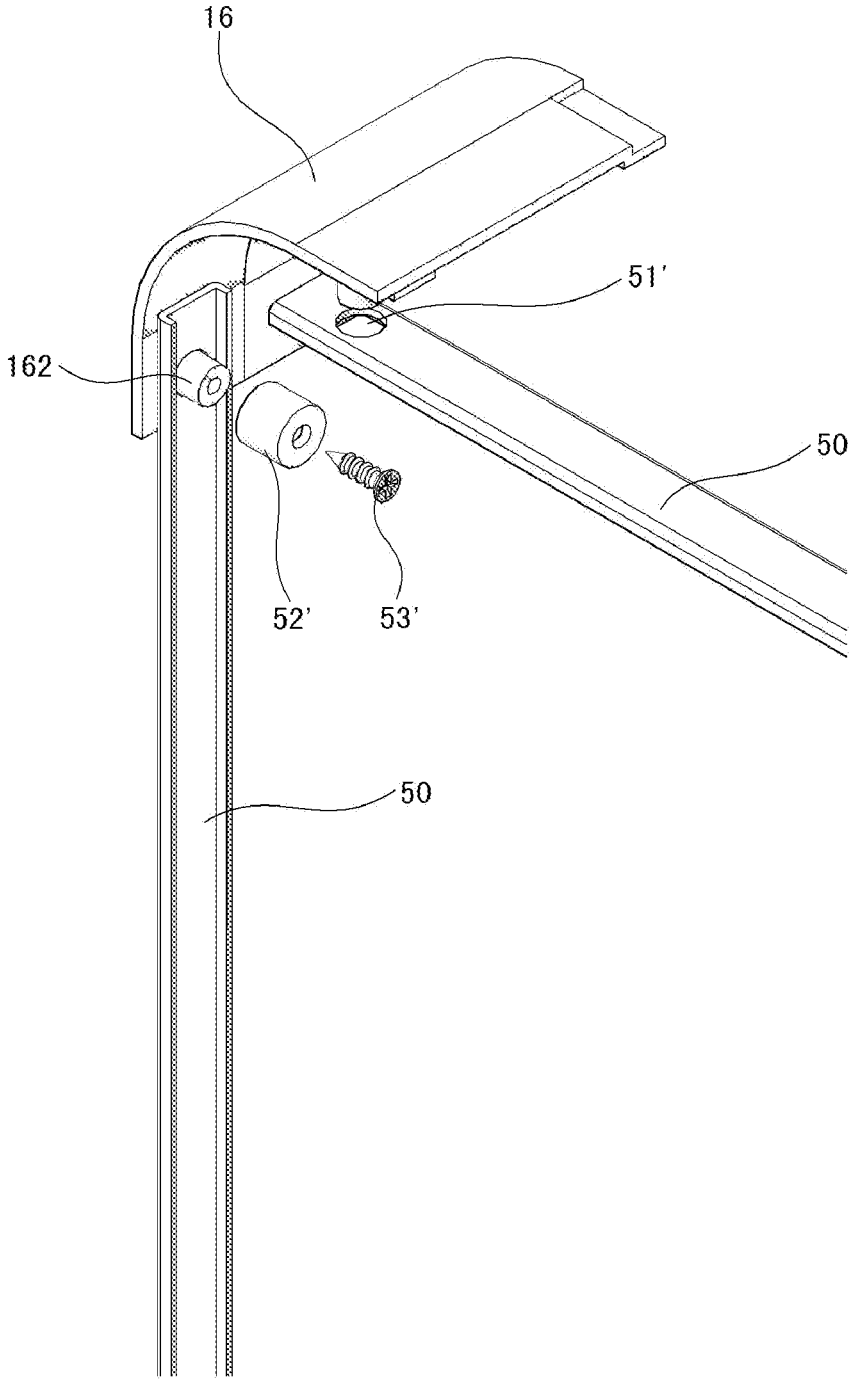
FIG. 8 illustrates the structure diagram of the connection of another type of supporting connectors of the ultralight suitcase of the present invention.

As shown in FIG. 8, in the present invention, the supporting connector 50 can also adopt a strip supporting connector, a positioning hole 51' can respectively be arranged at two ends of the supporting connector 50, a mounting stub 162 is arranged on the upper corner connector 16 in the position corresponding to the positioning hole 51', and the supporting connector 50 is installed on the mounting stub 162 of the upper corner connector 16 from the positioning hole 51' through a mounting piece 52' and a screw 53'.

Similarly, the connection structures of the upper connector 11, the upper connector 12, the lower connector 13, the lower connector 14, the upper corner connector 15, the lower corner connector 17 and the lower corner connector 18 connecting with the supporting connector 50 can also adopt the connection structures as shown in FIG. 8, which description is not repeated here.

Figure 9:
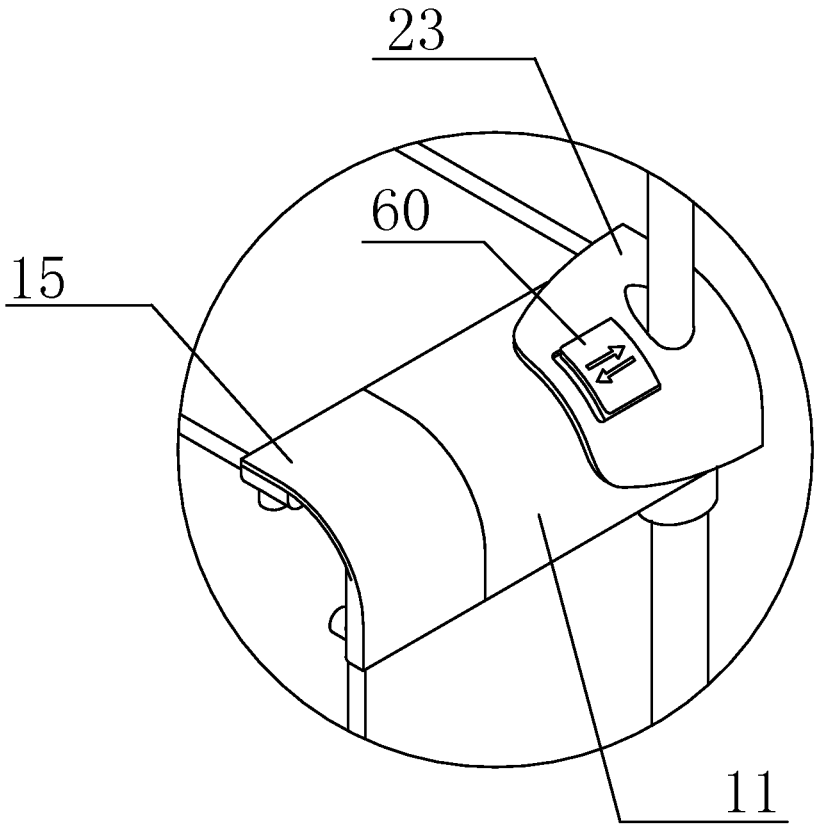
FIG. 9 illustrates the structure diagram of the connection of upper connectors and the pull rods of the ultralight suitcase of the present invention.
Figure 10:
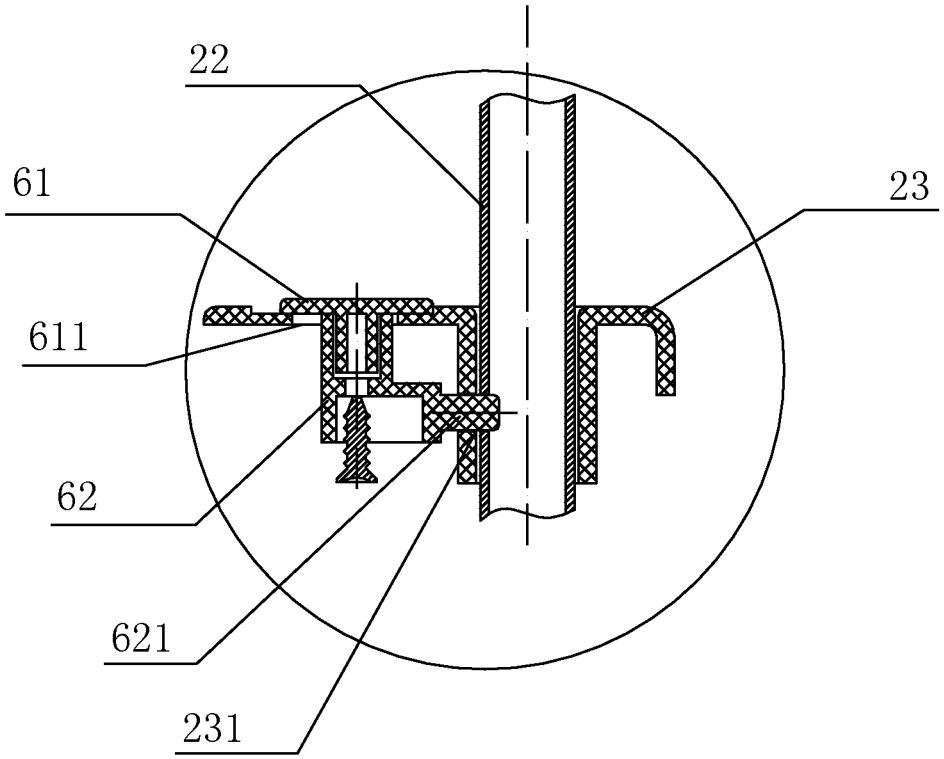
FIG. 10 illustrates the structure diagram of the locking piece of the ultralight suitcase of the present invention.

As shown in FIG. 3 and FIG. 9, the outer tubes 21 of pull rods 20 are respectively connected between the upper connector 11 and the lower connector 13 and between the upper connector 12 and the lower connector 14, the inner tubes 22 of the pull rods 20 are arranged inside the outer tubes 21 to ensure that the inner tubes 22 be stretched inside the outer tubes 21, the pull rods 20 are secured in the case framework 10 through an upper cover plate 23, and the upper cover plate 23 is fixedly connected with the upper connector 11 and the upper connector 12, respectively.

A locking piece 60 for locking the pull rods 20 is arranged on the upper cover plate 23; the locking piece 60 comprises a locking switch 61 and a lock body 62; the locking switch 61 and the lock body 62 are connected; the limiting hole 231 is arranged in the upper cover plate 23; the limiting block 621 which can extend into the limiting hole 231 to limit inner tubes 22 of the pull rods 20 is arranged on the lock body 62; the locking switch 61 drives the lock body 62 to slide back and forth in a mobile hole 611 arranged on the upper cover plate 23; the inner tubes 22 of the pull rods 20 are limited and locked through the limiting block 621 extending into the limiting hole 231.

The above illustrates and describes the basic principles, main characteristics and advantages of the present invention. A person having ordinary skill in the art understands that the invention is not limited by the embodiments described herein. The embodiments and description of the present application only describe the principles of the invention. The invention may have various variations and improvements on the premise that the spirit and the scope of the invention are not deviated. All the variations and improvements are contemplated by the present invention. The claimed scope of the invention is defined by attached claims and equivalents thereof.

The invention claimed is:

1. An ultralight suitcase comprising:

a case framework; case material covered on the case framework; pull rods installed on the case framework; and wheels and supporting legs installed at the bottom part of the case framework, wherein the case framework comprises:

upper connectors connected with the two ends of the pull rods;

lower connectors connected with the wheels at the lower part of the case framework;

upper corner connectors connected with the upper connectors and lower corner connectors connected with the lower connectors;

the bottom parts of the lower corner connectors are connected with the supporting legs;

the upper connectors and the lower connectors are connected through supporting connectors;

the upper corner connectors and the lower corner connectors are connected through supporting connectors;

the upper connectors are connected through supporting connectors;

the lower connectors are connected through supporting connectors;

the upper corner connectors are connected through supporting connectors; and the lower corner connectors are connected through supporting connectors;

wherein outer tubes of the pull rods are connected between the upper connectors and the lower connectors; inner tubes of the pull rods are arranged inside the outer tubes; the pull rods are secured in the case framework through an upper cover plate; and the upper cover plates are fixedly connected with the upper connectors; and wherein locking pieces for locking positions of the pull rods are arranged on the upper cover plates; the locking pieces comprising a locking switch and a lock body; the locking switch is connected with the lock body; a limiting hole is arranged on the upper cover plate; and a limiting block that can extend into the limiting hole to limit the pull rods is arranged on the lock body.

2. The ultralight suitcase according to claim 1, wherein screw stubs are arranged on the upper connectors on the inner sides of the connected sides between the upper connectors and the upper corner connectors; screw holes are arranged on the upper corner connectors corresponding to the positions of the screw stubs on the upper connectors; and the upper connectors and the upper corner connectors are connected by fastening the screw stubs into the screw holes.

3. The ultralight suitcase according to claim 1, wherein screw stubs are arranged on the lower connectors on the inner sides of the connected sides between the lower connectors and the lower corner connectors; screw holes are arranged on the lower corner connectors corresponding to the positions of the screw stubs on the lower connectors; and the lower connectors and the lower corner connectors are connected by fastening the screw stubs into the screw holes.

4. The ultralight suitcase according to claim 1, wherein splicing connectors are arranged in the connected positions between the upper connectors, the lower connectors, the upper corner connectors, the lower corner connectors and the supporting connectors; a mounting through-hole for splicing the corresponding supporting connector is arranged in the center of the splicing connector; fastening holes are arranged on the splicing connectors; and the supporting connectors are secured through fastening screws.

5. The ultralight suitcase according to claim 1, wherein the supporting connector has the shape of a strip with a flat frame; positioning holes are respectively arranged at two ends of each supporting connector; mounting stubs are arranged on the upper connectors, the lower connectors, the upper corner connectors and the lower corner connectors in the positions corresponding to the positioning holes; and the supporting connectors are installed on the mounting stubs on the upper connectors, the lower connectors, the upper corner connectors and the lower corner connectors from the positioning holes through mounting pieces.

* * * * *